US005205149A

United States Patent [19]

Hayashi

[11] Patent Number: 5,205,149

[45] Date of Patent: Apr. 27, 1993

[54] PRESS MACHINE HAVING ADJUSTABLE STRIKER

[75] Inventor: Tetsuji Hayashi, La Mirada, Calif.

[73] Assignee: Amada Mfg. America Inc., La Mirada, Calif.

[21] Appl. No.: 757,578

[22] Filed: Sep. 11, 1991

[51] Int. Cl.[5] ..... B26D 5/08

[52] U.S. Cl. ..... 72/446; 72/442; 72/453.06; 83/552

[58] Field of Search ..... 72/441, 443, 453.03, 72/453.06, 453.07, 472, 446; 83/549, 552, 609.1

[56] References Cited

U.S. PATENT DOCUMENTS

| | | | |
|---|---|---|---|
| 3,143,007 | 8/1964 | Thompson | 72/453.03 |
| 3,685,380 | 8/1972 | Daniels | 83/552 |
| 3,691,946 | 9/1972 | Ando | 72/453.07 |
| 3,717,059 | 2/1973 | Daniels | 83/552 |
| 3,783,672 | 1/1974 | Morgolenko et al. | 72/407 |
| 4,235,088 | 11/1980 | Kreiskorte | 72/453.07 |
| 4,250,785 | 2/1981 | Morishita et al. | 83/552 |
| 4,341,137 | 7/1982 | Leitch et al. | 83/552 |

FOREIGN PATENT DOCUMENTS

| | | | |
|---|---|---|---|
| 2600948 | 7/1977 | Fed. Rep. of Germany | 72/453.03 |
| 0013236 | 1/1991 | Japan | 83/552 |

*Primary Examiner*—David Jones
*Attorney, Agent, or Firm*—Wigman & Cohen

[57] ABSTRACT

A press machine is disclosed for which the main components are a movable ram and a striker device connected to the ram. The striker device includes a striker for striking a tool of the press machine and a drive mechanism to adjust the position of the striker with respect to the tool.

5 Claims, 5 Drawing Sheets

PRESS MACHINE HAVING ADJUSTABLE STRIKER

BACKGROUND OF THE INVENTION

The present invention relates to a press machine wherein a piston for a striker device connected to a freely vertically movable ram on the press machine is caused to move.

Conventionally, in a punch press such as a turret punch press or the like, a material is subjected to a punching process through the collaborative operation of a punch and die by applying a striking force to a punch from a striker device connected to a freely vertically movable ram. The striker is fabricated from a block or a plate, and it is impossible to modify the stroke of the striker or to adjust an open height (or shut height).

With a striker of the above-described conventional structure, the stroke is regulated by the vertical movement of the ram. Accordingly, there is the problem that the movement of the striker cannot exceed the stroke of the ram, and it is not possible to modify the stroke or stop the punch midway by adjusting the open height (or shut height).

SUMMARY OF THE INVENTION

An object of the present invention is to provide, with due consideration to the drawbacks of such conventional devices, a press machine for punching, forming, etc., wherein the movement of the striker can exceed the stroke of the ram, and wherein it is possible to modify the stroke or stop the tool midway by adjusting the open height (or shut height).

This object is achieved in the present invention by the provision of a press machine comprising a movable ram and a striker device connected to the ram, to strike a tool; the striker device including a striker for striking the tool and a drive mechanism to adjust the position of the striker with respect to the tool.

The drive mechanism causes the striker to move downward or upward and the position of the striker is adjusted with respect to the tool. Accordingly, it is possible to modify the stroke or to adjust the open height (or shut height).

BRIEF DESCRIPTION OF THE DRAWINGS

These and other objects, features, and advantages of the present invention will become more apparent from the following description of the preferred embodiment taken in conjunction with the accompanying drawings, in which.

DETAILED DESCRIPTION OF THE PREFERRED EMBODIMENTS

Other features of this invention will become apparent in the course of the following description of exemplary embodiments which are given for illustration of the invention and are not intended to be limiting thereof.

Figure 1:
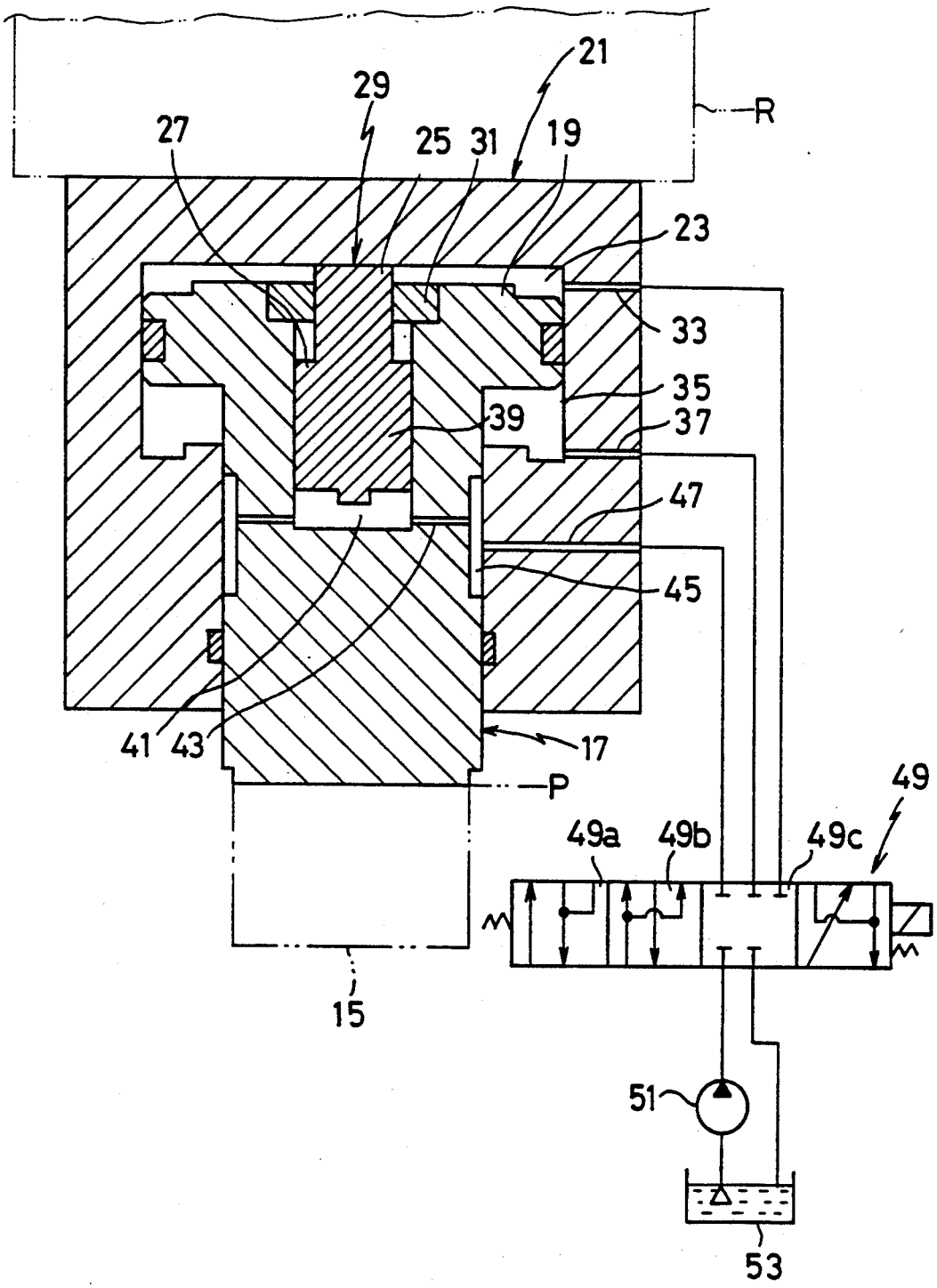
FIG. 1 is a vertical section of a front elevation showing an embodiment of a striker device of a press machine of the present invention.
Figure 5:
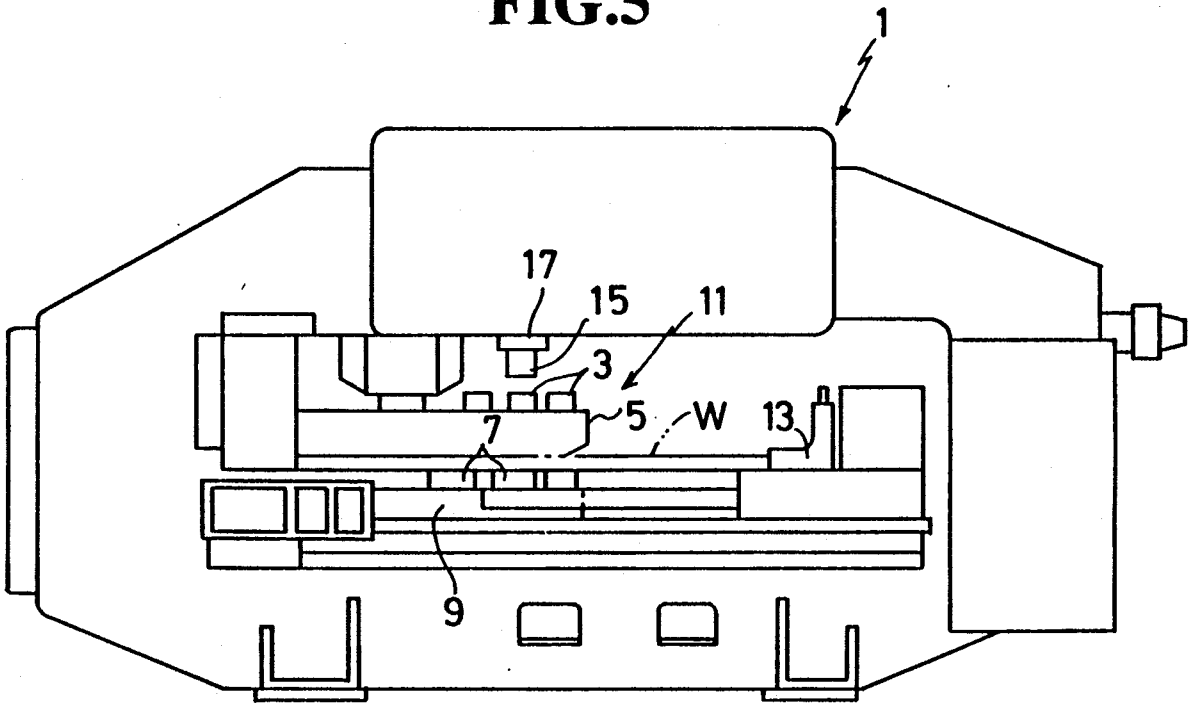
FIG. 5 is a front elevation showing a punch press as an example of the application of this embodiment of the present invention.

The present invention will now be explained with reference to the drawings for an embodiment applied to a turret punch press. FIG. 5 is a front elevation of a conventional turret punch press 1 provided with a turret device 11 comprising a disk-shaped upper turret 5 provided with a plurality of punches 3, 3 . . . on its periphery, and a disk-shaped lower turret 9 provided with a plurality of dies 7, 7 . . . on its periphery, each die 7 being positioned to correspond with a punch 3. Between the punches 3, 3 . . . and the dies 7, 7 . . . , a workpiece W can be moved both longitudinally and laterally by a clamp device 13. A striker device with a striker 15 is mounted on a ram R (FIG. 1). The ram R is moved vertically by an eccentric shaft (or a hydraulic cylinder) which has been omitted from the drawing. Each punch 3 can be moved vertically in this vertical operation, and the workpiece W is punched between the punch 3 and the die 7.

FIG. 1 is a vertical section of a front elevation showing the principal parts of the present invention. The striker 15 is linked to a press piston. A pressure section 19 of the press piston 17 is intimately inserted into a pressure chamber 23 of a hydraulic cylinder 21. The cylinder 21 is provided on the lower portion of a freely vertically movable ram R. A mini-piston 29 on which a head section 25 and a shoulder section 27 are formed, is enclosed by the pressure section 19 of the press piston 17. The mini-piston 29 is constructed with free movement at a fixed stroke until the shoulder section 27 impacts a stopper section 31 of the pressure section 19.

A pressure passage 33 for transmitting hydraulic pressure to the pressure chamber 23 is provided in the hydraulic cylinder 21. A return passage 37 is also provided for transmitting hydraulic pressure to a return chamber 35. In addition, a pressure chamber 41 faced by a pressure section 39 on the side of the mini-piston 29 opposite the head section 25 is provided in the piston 17. A mini-piston passage 43 for transmitting hydraulic pressure to the pressure chamber 41 is formed in the piston 17. The mini-piston passage 43 is connected to a passage 47 in the hydraulic cylinder 21 through a ring-shaped passage 45 formed in the piston 17.

The pressure passage 33, the return passage 37, and the passage 47 are connected to a hydraulic pressure pump 51 and to a tank 53 through a circuit switching valve 49.

Next, the operation of the embodiment with this configuration will be explained. When the pressure passage 33, the return passage 37, and the passage 47 are opposite a middle port **49*c* of the circuit switching valve 49, as in FIG. 1, the head section 25 of the mini-piston 29 contacts the wall of the pressure chamber 23 as a result of the residual hydraulic pressure in the pressure chamber 41, and the piston 17** is in an inactive position P.

Figure 2:
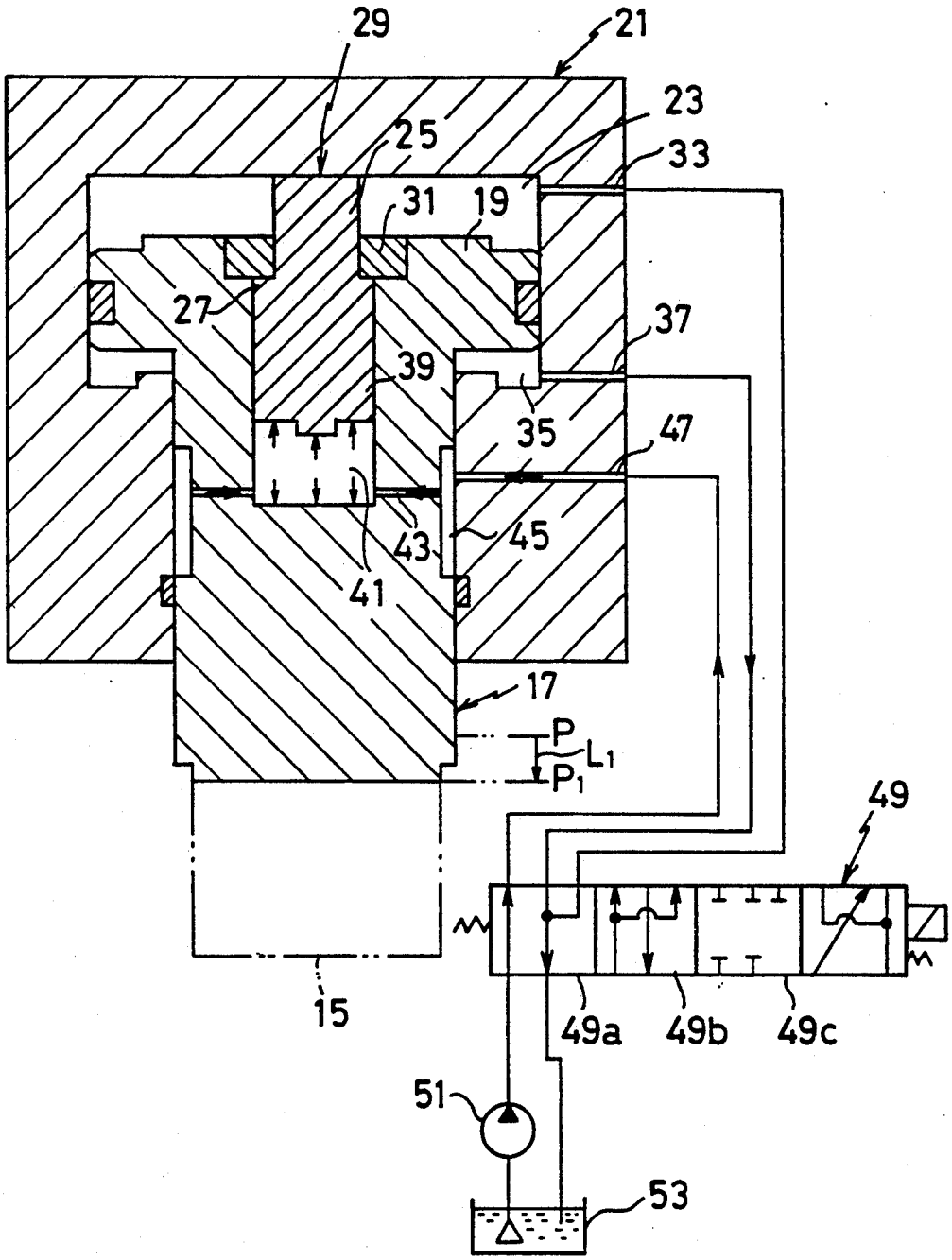
FIG. 2 is a vertical section of a front elevation showing a mini-piston of this embodiment in the projected state.

Then, as shown in FIG. 2, when the pressure passage 33, the return passage 37, and the passage 47 are connected to a first port **49*a* of the circuit switching valve 49, pressure is applied by the hydraulic pressure pump 51 through the passage 47, the ring-shaped passage 45, and the mini-piston passage 43 to the pressure chamber 41. The pressure acting on the inside of the pressure chamber 41 presses the piston 17 downward until it reaches a first descent position P1 after being lowered only the distance of a stroke L1 from the inactive position P of the piston 17 in FIG. 1**.

Figure 3:
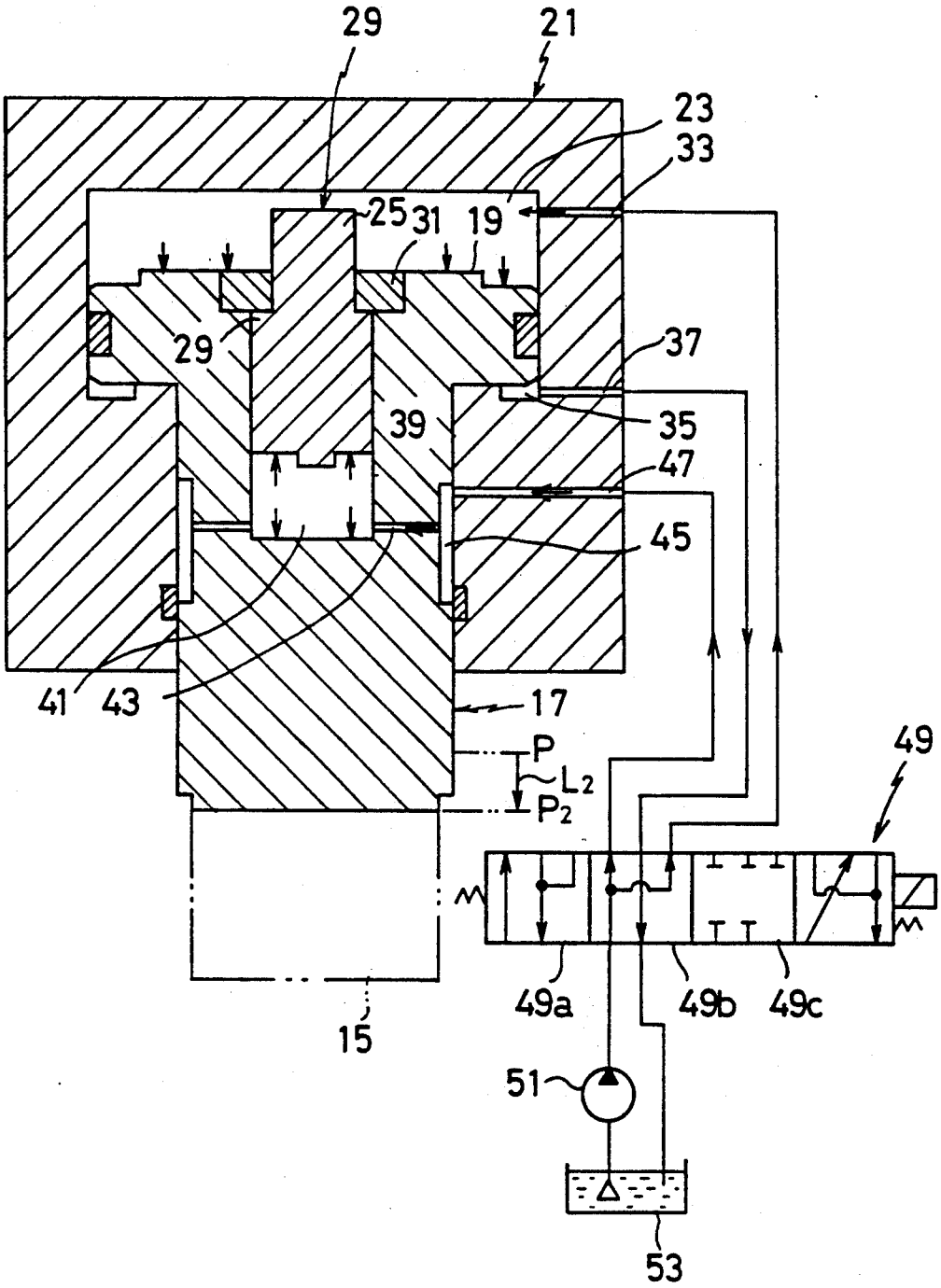
FIG. 3 is a vertical section of a front elevation showing the state of a piston of this embodiment after a one-stroke projection.

Then as shown in FIG. 3, when the pressure passage 33, the return passage 37, and the passage 47 are connected a second port 49*b* of the circuit switching valve 49, the pressure from the hydraulic pressure pump 51 is maintained on the pressure chamber 41 through the passage 47, the ring-shaped shaped passage 45, and the mini-piston passage 43, and this pressure is applied to the pressure chamber 23 from the pressure passage 33. As a result of the hydraulic pressure in the pressure chamber 23, the piston 17 is pressed even further downward and the pressure section 19 is caused to project from the hydraulic cylinder 21 at a single stroke until it contacts the opposite wall of the pressure chamber 23. The piston 17 reaches a second descent position P2, after being lowered only the distance of a stroke L2 from the inactive position P of the piston 17 in FIG. 1.

Figure 4:
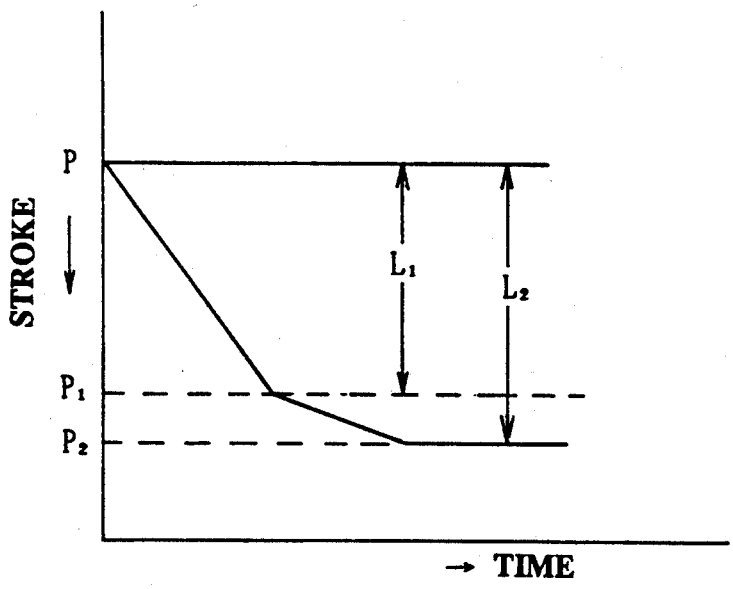
FIG. 4 is graph illustrating the descent velocity characteristics of this embodiment of the present invention.

Because the capacity of the pressure chamber 41 is appreciably smaller than the capacity of the pressure chamber 23, as shown in a model example in FIG. 4, the downward velocity of the piston 17 from the inactive position P to the first descent position P1 is high, and from the first descent position P1 to the second descent position P2 the velocity is low, or as shown by the solid line the piston can come to a full stop.

With this type of two-stage stroke and downward velocity characteristics, for example, a punch 3 at the inactive position P can descend at high speed to the close proximity of the first descent position P1 to contact the workpiece W, then descend slowly to the second descent position P2, to punch the workpiece W as specified, or to carry out a forming process or the like. As a result, the vibration and noise that occurs during a punching or forming process can be reduced.

Then, as outlined above, the specified two-stage stroke and downward velocity characteristics can be obtained through the simple mechanical configuration wherein the mini-piston 29 is fitted into the piston 17.

Because the press machine has the configuration outlined in the foregoing explanation, it is possible to adjust the stroke of the striker on the ram. Specifically, when pressure is transmitted to the mini-piston passage 43 from the projection action of the mini-piston 29, the hydraulic piston 17 is caused to project at high speed from the cylinder 21 at a fixed stroke only. Next, the transmission of pressure is maintained on the mini-piston passage 43, and when hydraulic pressure is transmitted to the pressure passage 33, the pressure acts on the pressure section 19 of the piston. This causes the piston 17 to slowly project from the cylinder 21 in a single stroke until the pressure section 19 contacts the opposite wall of the pressure chamber 23. In this manner, by means of a simple mechanical structure wherein the mini-piston 29 is fitted into the hydraulic piston 17 a specified two-stage stroke and descent speed characteristics are obtained. This makes it possible to provide the equipment at low cost, and to restrain the noise and vibration caused by the press machine during the punching operation and the like, for example, which is extremely effective in adjusting the forming depth during a forming process.

By suitable adjusting the length of the mini-piston 29 the two-stage stroke and downward velocity characteristics can be variously modified. For example, if the piston 29 were fabricated as a large number of laminated disk, by suitably increasing or decreasing the number of disks built into the cylinder the operation of modifying the two-stage stroke and downward velocity characteristics can be made very simple.

Further, it should be understood that another mini-piston could be fitted into the mini-piston 29, if necessary, for three-stage stroke operation.

While the cylinder 21 has shown in the above embodiment as a drive mechanism to adjust the position of the striker, any known drive mechanisms other than the hydraulic cylinder can be used in the present invention.

What is claimed is:

1. A press machine comprising:

a movable ram;

a striker device connected to the ram, to strike a tool;

the striker device including a striker for striking the tool and a drive mechanism to adjust the position of the striker with respect to the tool, the drive mechanism comprising a hydraulic cylinder having a pressure chamber formed therein;

a piston fitted into the hydraulic cylinder, said piston having a pressure section formed therein; and a pressure passage for transmission of hydraulic pressure to the pressure chamber of the hydraulic cylinder;

the piston being connected to the striker and caused to move by the transmission of hydraulic pressure to the pressure passage;

a freely reciprocating mini-piston, having a fixed stroke and having a pressure section, slidably mounted in a direction of projection into the pressure section of the piston;

a mini-piston passage which transmits hydraulic pressure to the pressure section of the mini-piston, in the direction of projection of the mini-piston; wherein the piston is caused to move by the transmission of hydraulic pressure to the mini-piston passage.

2. A press of claim 1, wherein the piston and the mini-piston have velocities of motion which are different from each other.

3. A press of claim 2, wherein the capacity of the pressure section of the mini-piston is smaller than the capacity of the pressure section of the piston.

4. A hydraulic cylinder device which connects a ram of a punch press to a striker for striking a tool, comprising:

a cylinder connected to the ram;

a piston rod formed with a piston and connected to the striker;

a piston member inserted in the piston so as to act as a vertically movable mini-piston in the piston;

hydraulic means for causing the piston member to extrude from the piston toward the ram and contact and push the cylinder and thereby causing the piston to move toward the tool; and hydraulic means for moving the piston toward the tool.

5. The device of claim 4, wherein the striker is movable toward the tool in two stage strokes by the hydraulic means for moving the piston member and the piston.

* * * * *

UNITED STATES PATENT AND TRADEMARK OFFICE

CERTIFICATE OF CORRECTION

PATENT NO. : 5,205,149

DATED : April 27, 1993

INVENTOR(S) : Tetsuji Hayashi

It is certified that error appears in the above-indentified patent and that said Letters Patent is hereby corrected as shown below:

IN THE TITLE PAGE:

[73] Assignee should be: --Amada Mfg America Inc.--

Signed and Sealed this

Thirty-first Day of January, 1995

*Attest:*

Bruce Lehman

BRUCE LEHMAN

*Attesting Officer*

*Commissioner of Patents and Trademarks*